United States Patent [19]

Foreman et al.

[11] 4,227,592

[45] Oct. 14, 1980

[54] DUPLEX DOOR SAFETY RECYCLING SYSTEM

[76] Inventors: Floyd L. Foreman, 15906 Tall Shadows, Houston, Tex. 77032; Emmet D. Fenton, 3806 Crater Lake Ct., Irving, Tex. 75062

[21] Appl. No.: 972,515

[22] Filed: Dec. 22, 1978

[51] Int. Cl.[3] ..... B66B 13/00

[52] U.S. Cl. ..... 187/56; 49/27; 200/61.43

[58] Field of Search ..... 187/56, 52 R, 51, 52 LC, 187/53, 54, DIG. 1; 49/26, 27, 28; 200/61.43

[56] References Cited

U.S. PATENT DOCUMENTS

| | | | |
|---|---|---|---|
| 2,235,381 | 3/1941 | McCormick | 187/56 |
| 3,315,766 | 4/1967 | Tucker, Jr. | 187/56 |
| 3,868,000 | 2/1975 | Spear et al. | 187/52 R |
| 3,903,647 | 9/1975 | Hubbard et al. | 49/27 |
| 4,045,650 | 8/1977 | Nestor | 200/61.43 |

*Primary Examiner*—Robert J. Spar
*Assistant Examiner*—Kenneth Noland
*Attorney, Agent, or Firm*—Robert G. Boydston

[57] ABSTRACT

A duplex door safety recycling system, primarily for elevator doors, that includes a clutch mounted safety switch for activating an electrical control circuit to recycle and open the duplex doors when an external force is applied to a clutch-driven door in opposition to the force moving the door in the direction of closing.

7 Claims, 9 Drawing Figures

DUPLEX DOOR SAFETY RECYCLING SYSTEM

Figure 1:
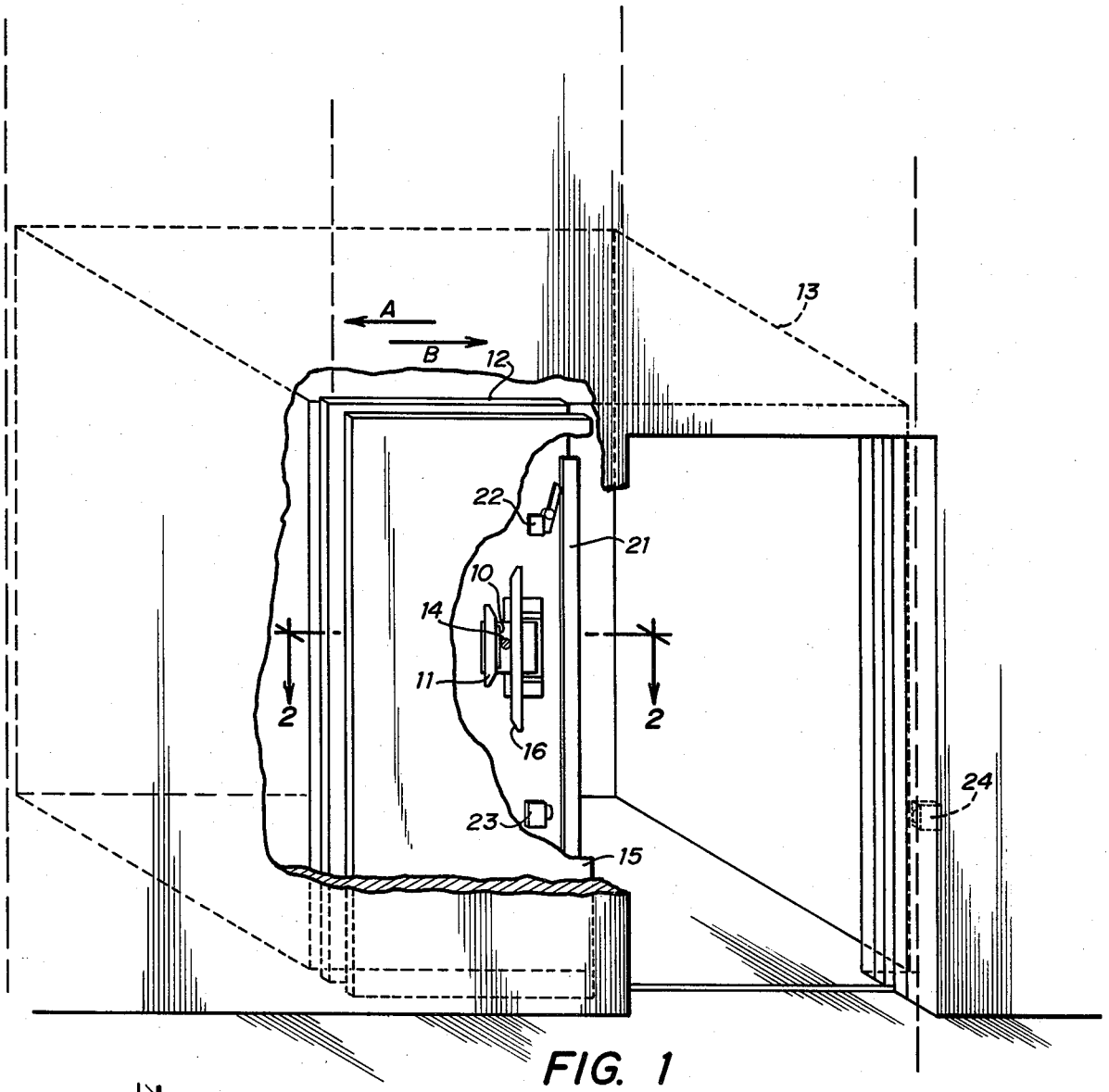

This invention relates in general to safety systems for electric motor driven doors and in particular to a safety system on automatic electric motor driven duplex doors used for modern passenger-actuated automatic elevators. The invention provides for interrupting and reversing the door closing cycle by actuating a safety switch mounted on the closing side of a door clutch through a force exerted directly on a clutch driven door opposing the door closing force, thereby activating an electrical safety circuit that reverses the rotational direction of a motor driving a door clutched to the clutch driven door.

Typical automatic electric motor driven sliding door operating sytems on elevators include an electric motor mounted on top of an elevator car, driving through belts, pulleys and linkages, a door or pair of doors incorporated into the car structure; a clutch mounted on an elevator car door and on a building floor door or pairs of doors, commonly called a hoistway or hatch door, for driving the hoistway door in opening and closing cycles from the motor driven elevator car door; and a motor control circuit having safety circuit means for interrupting and reversing the door closing cycle when safety devices mounted on the elevator car or car door are actuated. Typical safety devices are a safety edge device mounted on the car door so that a slight force exerted on the safety edge, such as by a hand pushing against the direction of closing, will move the safety edge against the contact point of a micro-switch to activate the safety circuit, and electric light beam devices mounted on the elevator car so that interruption of a light beam across the car door opening will activate the safety circuit to interrupt and reverse the door closing cycle.

None of the commonly used safety devices and systems are actuated from the hoistway door. Hoistway doors are typically 3 to 6 inches in thickness and a hand, inserted into the door opening in an attempt to interrupt the closing cycle, that does not either break a safety circuit light beam or contact the car door safety edge in such a manner as to actuate the micro-switch of the safety circuit can be severely injured by the closing force of the hatch door. Many injuries and damages occur when hands feet or objects are caught in a closing hoistway door in this manner. Most of these injuries and damages could be prevented with a safety circuit system incorporating means to interrupt and reverse the door closing cycle in response to a force exerted against the closing hoistway door.

Application of the above described presently used safety devices to hoistway doors would require an installation on each hoistway door of every building floor. The quantity of the safety devices required in a multi-floor building would therefore be very expensive to install and maintain. An effective safety system actuated from the hoistway doors but mounted only on the elevator car doors would however be economically feasible due to minimization of the cost of installation and the expense and time required for maintenance.

It is, therefore, a principal object of this invention to provide an automatic electric motor driven duplex door operating system safety circuit with means to activate the circuit through a force exerted directly against a clutch driven door.

Another object is to provide a method and means for interrupting the closing cycle of such doors from the clutch driven door or doors and automatically reversing the closing cycle to cause reopening of the doors.

Still another object is to prevent injury and damage by increasing the safety of such automatic door operating systems by providing a means for activating a safety circuit from a hoistway door.

A further object is to provide an economical switch and safety system, mountable on an elevator car door and operable from a force exerted on a hoistway door, in an elevator door operating system.

It is also an object of this invention to provide clutch parts and clutches, incorporating such a switch, mountable and operable on existing and new automatic electric motor driven duplex door operating systems.

Features of the invention useful in accomplishing the above objects include, in an automatic electric motor driven duplex door operating system and safety circuit, an electric switch having a flexible dielectric body member linearly deflectable by an externally applied lateral force, a pair of switch contacts closable or openable upon a given deflection of said dielectric body member, a clutch member incorporating means for mounting and carrying said switch, and means for electrically interconnecting said switch to the door operating system safety circuit.

Specific embodiments representing what are presently regarded as the best modes of carrying out the invention are illustrated in the accompanying drawings.

Figure 2:
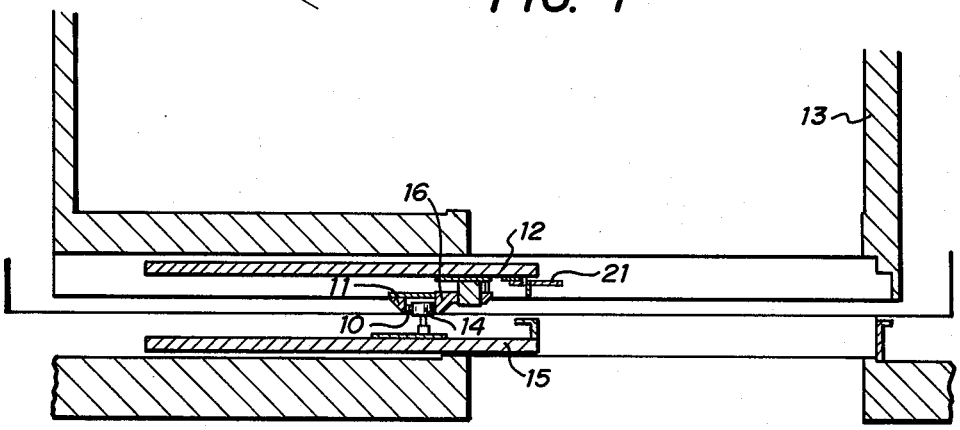
Figure 3:
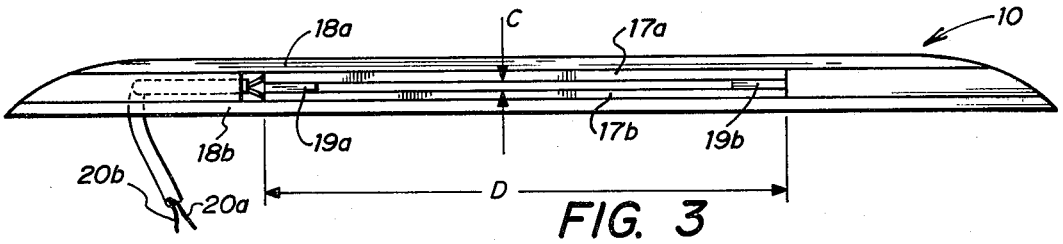
Figure 4:
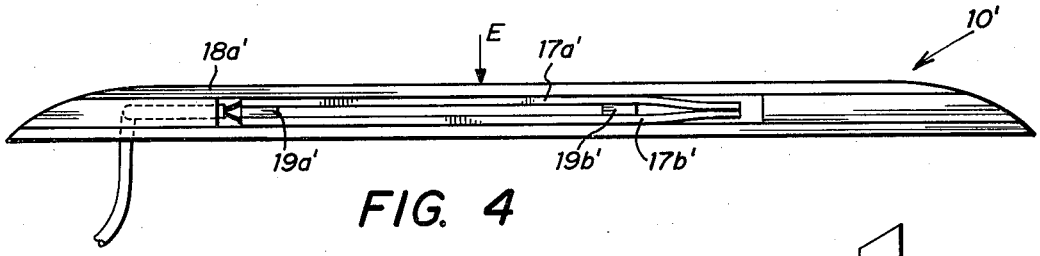
Figure 5:
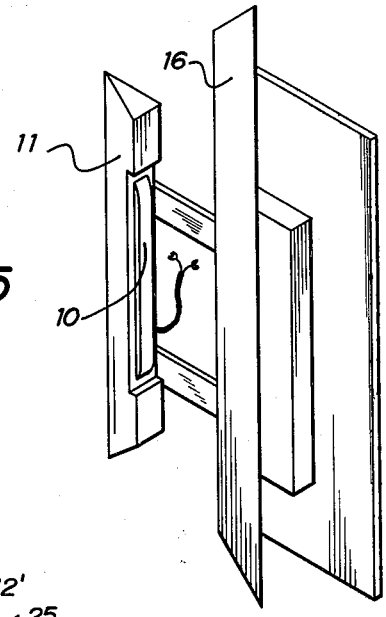
Figure 6:
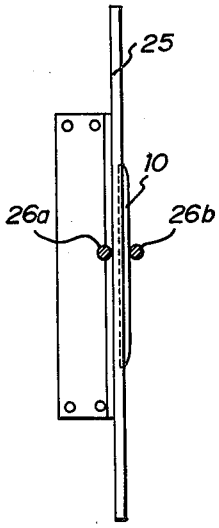
Figure 7:
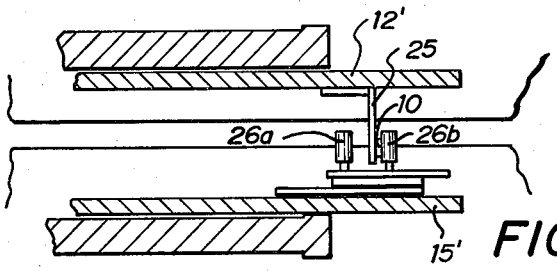
Figure 8:
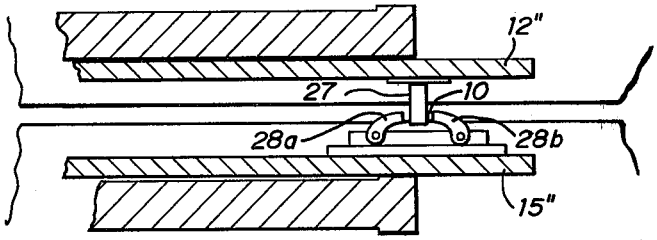
Figure 9:
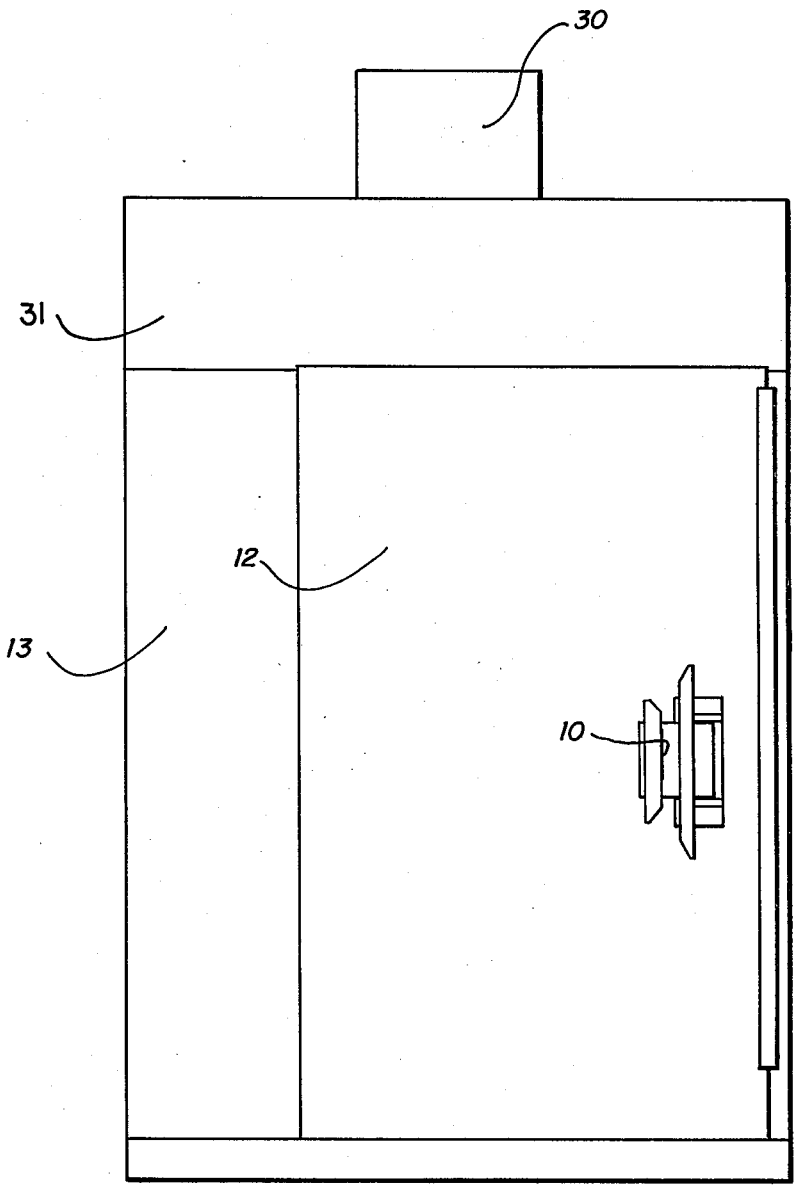

In the drawings:

FIG. 1 represents a perspective view of an elevator car and a hoistway door clutch-driven from an elevator car door, partially cross sectioned to show the clutch mechanism and safety switch;

FIG. 2, a cross sectional view through the car door, hoistway door, safety switch and clutch mechanism;

FIG. 3, a side elevation view of a hoistway door safety system switch having normally open contacts;

FIG. 4, a side elevation view of a hoistway door safety system switch having normally closed contacts;

FIG. 5, a perspective view of a typical clutch mechanism incorporating a hoistway door safety switch into the clutch construction;

FIG. 6, an elevation view of a vane drive clutch mechanism having a hoistway door safety system switch mounted thereon;

FIG. 7, a top plan view of the vane drive and switch of FIG. 6;

FIG. 8, a plan view of another type of vane drive clutch mechanism having a hoistway door safety switch mounted on the vane;

FIG. 9, a front elevation view of a typical single door elevator car with door operating motor mounted on the car.

Referring to the drawings:

The hoistway door safety switch 10 of FIG. 1 is affixed to a clutch door closing cam member 11 mounted on a motor driven elevator car door 12. An electric motor 30, usually direct current type and depicted symbolically in FIG. 9, is mounted on a platform 31, on top of the elevator car 13, for driving the car door 12 through a conventional linkage mechanism. A roller 14, spindle-mounted on a hoistway door 15, is vertically centered between clutch member 11 and clutch door opening cam member 16, also mounted on car door 12, when the doors are vertically aligned upon the elevator car 13 stopping at a building floor. Typically, two vertically spaced rollers are used but for clarity only one roller is illustrated in the drawings. An interstice on either side of the roller 14 provides running clearance between it and the clutch members 11 and 16 during vertical movement of the elevator car 13.

Upon initiation of a door opening cycle through the motor control circuit, electric current is fed to the motor atop the elevator car 13 causing rotation of the motor in the appropriate direction for opening the car door 12. Clutch cam member 16, carried by the motor driven car door 12 in direction A, contacts the roller 14 and thereby drives the hoistway door 15 in direction A to open both doors 12 and 15 simultaneously. Upon initiation of the door closing cycle by the motor control circuit reversing the current through the motor, car door 12 moves in direction B and clutch cam member 11 engages the roller 14 to drive hoistway door 15 in direction B along with car door 12.

During the door closing cycle, referring to FIGS. 1 and 2, with the hoistway door safety switch 10 affixed on clutch member 11, the actual contact between roller 14 and clutch member 11 is on the body of the switch 10, and the closing force from clutch member 11 is transmitted to the roller 14 through the switch body 10. The safety switch 10 will remain open under the normal closing force exerted by clutch member 11 against roller 14 to overcome the frictional and inertial resistance of hoistway door 15. The door closing cycle will continue unless the closing resistance force of hoistway door 15 is increased by the addition of an externally applied force such as hand pressure exerted on the hoistway door 15 in direction A opposing the closing movement of the door 15 in direction B. When the closing resistance force is increased in this manner, the safety switch 10 contacts will close and the door closing cycle immediately reversed to a door opening cycle, as further described below.

FIG. 3 depicts a typical hoistway door safety switch 10 of the preferred embodiment. A pair of electrically conductive contact strips 17a and 17b are positioned in the switch body 10 between flexible dielectric body members 18a and 18b and spaced apart by dielectric spacers **19*a* and 19*b*. Electrical wires 20*a* and 20b leading from the contact strips 17*a* and 17*b*, respectively, and through the switch body are provided to connect the switch into the motor control system safety circuit. Although only one of dielectric body members 18*a* and 18*b* must flex to close the contact strips 17*a* and 17*b*, the other being firmly mounted to the surface of clutch member 11, the body members 18*a* and 18*b* may be of identical structure to simplify manufacturing and to provide for reversible mounting of the switch. However, it is often desirable to taper the end portions of the outer body member 18*a* to provide, in event of insufficient clearance at the interstice previously described, smooth engagement of the roller 14 when the elevator car 13** is moving vertically.

The amount of force against a dielectric body member **18*a* required to deflect said body member and bring the associated contact strip 17*a* into contact with the other contact strip 17*b* and, thereby, close the switch 10 is determined by the yield strength of the dielectric material, the width and thickness of the body member 18*a*, the spacing of dimension C between the contact strips 17*a* and 17*b* and the length of the span D between dielectric spacers 19*a* and 19*b*. The switch 10 can thus be manufactured to various closing force specifications corresponding to the closing forces encountered in various clutch driven door arrangements. The resistance to closing of a hoistway door 14 in a typical elevator installation is field adjustable; therefore, the force exerted by clutch member 11, through safety switch 10, can be precisely adjusted, if necessary, according to the switch body member 18*a* deflection characteristics so that the member 18a deflects somewhat but the contact strips 17*a* and 17*b* do not engage one another during a normal door closing cycle. Then a small force exerted against the hoistway door 15 to resist closing increases the force of roller 14 on dielectric body member 18*a* causing greater deflection of the body member 18*a* so that the switch contacts 17*a* and 17*b*** engage one another and close the switch.

The foregoing describes a hoistway door safety switch and its use in an automatically operated elevator door safety system having a control circuit utilizing normally open switches. In such cases the safety switches are wired in parallel with the familiar "door open" switch on the control panel inside the elevator car and/or with the other safety devices. Some control circuits, however, use a normally closed "door open" switch, series wired with the (normally closed) safety switches. For such circuits, a variation of the hoistway door safety switch 10' as depicted in FIG. 4 is provided with normally closed contact strips **17*a*' and 17*b*'. The structure and operation of the switch 10' is essentially the same as previously discussed except that a roller pressing against switch body member 18*a*' at point E depresses contact strip 17*a*' inward and dielectric spacer 19*b*' acts as a fulcrum so that the outer end of control strip 17*a*' deflects away from the outer end of contact strip 17*b*', opening the switch 10'**.

A typical car door safety edge 21 with associated micro-switch 22 is shown in FIGS. 1 and 2, along with a photo-electric safety control system light source lamp 23 and light receiving cell 24. These devices are electrically wired to operate a relay in the motor control circuit so that either actuation of the micro-switch 22 by movement of the safety edge 21 or interruption of the light beam energizes (or deenergizes) the relay to cause the motor control circuit to reverse the direct current flow and, thereby, reverse the motor rotation and open the doors. Similarly, interruption of the light beam between the lamp 23 and cell 24 causes the relay wired to these devices to close (or open) and the motor direction of rotation to reverse, opening the car door 12. As can be seen in FIGS. 1 and 2, these safety devices are mounted on the elevator car door 13 so that a hand, foot, body or object moving from the building floor toward the elevator car 13 must enter the door opening to at least the extent of the hoistway door 15 depth to either interrupt the light beam or contact the safety edge 21. Whether the safety circuit is arranged to operate through normally closed or normally open relays, the safety devices function in essentially the same manner.

Common variations of door clutch assemblies are depicted in FIGS. 5 through 8. The clutch assembly of FIG. 5 is that shown in FIGS. 1 and 2, with the hoistway door safety switch 10 mounted on clutch member 11. Clutch door opening cam member 11 is typically bolted into the clutch assembly. This member 11 as shown with switch 10 can be manufactured as a subassembly for replacement of standard existing clutch members that do not incorporate a switch 10.

The clutch assembly of FIGS. 6 and 7 has a vertical vane 25 mounted on a motor driven car door 12' and two rollers 26a and 26b mounted on a clutch-driven hoistway door 15'. Thus the driving force is exerted through the vane 25 on a roller 26a for door opening in the same manner as previously described for clutch member 16 and roller 14 of FIGS. 1 and 2. Also, for door closing the vane 25 engages the other roller 26b in the same manner that the clutch member 11 engages the roller 14 in FIGS. 1 and 2. Therefore, a hoistway door safety switch 10 (either normally closed or normally open type) can be interposed between the vane 25 and the roller 26b by mounting said switch on the vane surface facing the door closing roller 26b. The switch 10 will then function in the manner previously described. Vane and switch subassemblies can be manufactured for field replacement of existing vanes in the manner discussed for the clutch member 11 of FIG. 5.

The clutch assembly of FIG. 8 also utilizes a vane 27 mounted on a motor driven door 12" to drive a hoistway door 15" though pintle mounted drive blocks 28a and 28b that function the same as the rollers 26a and 26b in FIGS. 6 and 7. A hoistway door safety switch 10 may be interposed between the vane 27 and door closing drive block 28b by mounting on the vane 27 to provide essentially the same function and structure as for the above clutch assemblies.

A side opening or single duplex door system having one car door and one hoistway door have been depicted and described. The safety switch, clutch mechanism and motor controls operate in the same manner for center opening double duplex door arrangements where there are two elevator car doors and two hoistway doors that part from and close to the center of the door opening. In such arrangements, the clutch parts are mounted as shown on only one car door and one hoistway door with the respective opposing doors being mechanically connected to move in opening or closing cycles with the clutched doors. A force applied to oppose closing of either one of the opposed hoistway doors is transmitted to and will actuate the safety switch interposed in the clutch mechanism.

Whereas this invention is herein illustrated and described with respect to a plurality of embodiments, it should be realized that various changes may be made without departing from the essential contributions the art made by the teachings hereof.

I claim:

1. A method for activating an electrical safety control circuit in an automatically operated electric motor driven duplex door system having a first clutch member mounted on a clutch-driven door that is mounted to a building structure for lateral movement to close and open an elevator hoistway opening of the building structure and a second clutch member mounted on a motor-driven door that is mounted to a vertical movement elevator car structure for lateral movement to close and open an entrance-exit opening of the elevator car structure, where lateral movement of the motor-driven door when vertically aligned with the clutch-driven door causes simultaneous lateral movement of the clutch-driven door through engagement of the first clutch member by the second clutch member, comprising:

(a) exerting a force against a surface of the clutch-driven door opposing a closing force exerted against the first clutch member by the second clutch member with the clutch members engaged and the doors closing;

(b) flexing thereby a resilient body member in an electric circuit switch means interposed between the clutch members at the point of engagement of the clutch members, attached to the second clutch member and electrically wired to the safety control circuit;

(c) moving thereby a switch means contact element, positioned within the switch means for movement in unison with the resilient body member, to actuate the switch means.

2. The method of claim 1, wherein the electric switch means has two normally-open contacts closable with said flexing of the resilient body member.

3. The method of claim 1, wherein the electric switch means has two normally-closed contacts openable with said flexing of the resilient body member.

4. The method of claim 1, wherein activating the safety control circuit causes a reversal of the door closing cycle to a door opening cycle.

5. A method for recycling clutch-connected duplex doors from a doors closing cycle to a doors opening cylce comprising:

(a) affixing to a first clutch member mounted on a clutch-driven first door of a duplex doors system an electric current switch means in a position for transmission of all forces between said first clutch member and a second clutch member mounted on a clutch-driving second door of said duplex doors system during a doors closing cycle of said duplex doors system through a body of said electric current switch means:

(b) providing in said body for actuating said electric current switch means as a result of a closing force being transmitted through said body being increased by a force applied externally on said first door resisting the closing force;

(c) activating thereby as a result of so actuating the switch means an electrical control circuit electrically connected to said switch means and to an electric motor driving the clutch-driving second door in the doors closing cycle; and (d) reversing thereby a rotational direction of said causing the motor to drive the clutch-driving second door in a doors opening cycle.

6. In an elevator door safety system including, a driving door mounted on an elevator car structure for lateral movement across a doorway of said car structure, a driven door mounted on a building structure for lateral movement across an elevator hoistway doorway of the building structure, a clutch means connecting the driving door and the driven door during a door opening cycle and during a door closing cycle, an electric motor means connected by a power transmission means to the driving door and an electric motor control circuit means electrically connected to an electric current source and to said electric motor means, the improvement comprising: a duplex door recycling switch mounted on a driving clutch member that is attached to the driving door; the switch positioned for contact with a driven clutch member that is attached to the driven door so that during the door closing cycle a closing force transmitted between the driving clutch member and the driven clutch member must pass through a body of the switch; the body having a flexible body member deflectable by externally applied force; an electric curcuit contact make and break means positioned for actuation by deflection of said flexible body member in response to an increase in the closing force caused by an external resistant force on the driven door; and a circuit means for conducting an electric current through said circuit contact make and break means and on through said switch body to the electric motor control circuit means.

7. An elevator door recycling clutch member comprising a clutch member means and a recycling safety control switch means affixed to the clutch member means so that said switch means forms an engagement surface means and contacts a mating second clutch member means during a clutched engagement of the clutch member means and the second clutch member means with the clutch member means being mounted on a laterally movable door means of an elevator car means and the second clutch member means being mounted on a laterally movable door means of an elevator hoistway means in a building structure and the door means of the hoistway means being propelled in a hoistway doorway closing direction of the door means of the elevator car through the clutched engagement, having in said switch means electric circuit contact make and break means operable by a force externally applied to said switch through sid second clutch member means and adding to a force present on said switch means as a result of the clutch engagement with the door means of the building structure being driven by an electric motor means mounted on the elevator car means, and having electric circuit means connected to said electric circuit make and break means and to an electric motor control means controlling an electric current supply to said electric motor.

* * * * *